United States Patent [19]

Leininger

[11] Patent Number: 4,825,914

[45] Date of Patent: May 2, 1989

[54] FLUID DISPENSING NOZZLE CONSTRUCTION HAVING VAPOR CHECK VALVE MEANS THEREIN AND METHODS OF MAKING THE SAME

[75] Inventor: Donald L. Leininger, Cincinnati, Ohio

[73] Assignee: Dover Corporation, New York, N.Y.

[21] Appl. No.: 40,549

[22] Filed: Apr. 20, 1987

[51] Int. Cl.[4] ..... B65B 3/18

[52] U.S. Cl. ..... 141/59; 141/290; 141/302

[58] Field of Search ..... 141/290, 52, 59, 214, 141/301, 302; 251/190, 191, 359, 364, 900

[56] References Cited

U.S. PATENT DOCUMENTS 3,073,349 1/1963 Mitchell ..... 251/359 X 4,649,969 3/1987 McMath ..... 141/290

*Primary Examiner*—William A. Cuchlinski, Jr.

*Attorney, Agent, or Firm*—Kinney & Schenk

[57] ABSTRACT

A fluid dispensing nozzle construction and method of making the same are provided, the construction comprising a valve body having a dipensing spout extending therefrom, and a flexible bellows-like tube of polymeric material telescopically disposed on the spout and having opposed ends one of which is secured to the valve body and the other of which carries a face seal means for engaging an annular lip of a fill pipe of a fluid storage tank to seal around an opening in the fill pipe when the spout is inserted therein, the spout and the tube defining a vapor recovery passage therebetween that leads from the seal means to the valve body. The spout has a valve seat member thereon and the tube carries a valve member that moves therewith and that cooperates with the valve seat member to close the passage intermediate the seal means and the valve body when the tube is in a certain first compressed condition thereof between the seal means and the valve body and to open the passage when the tube is in a certain greater compressed condition thereof between the seal means and the valve body. The valve member has an internal annular surface that slides over at least part of the valve seat member in sealing engagement therewith to close the passage when the tube is in the first compressed condition thereof.

8 Claims, 9 Drawing Sheets

FLUID DISPENSING NOZZLE CONSTRUCTION HAVING VAPOR CHECK VALVE MEANS THEREIN AND METHODS OF MAKING THE SAME

BACKGROUND OF THE INVENTION

1. Field of the Invention

This invention relates to a new fluid dispensing nozzle construction and to a new method of making a fluid dispensing nozzle construction.

2. Prior Art Statement

It is known to provide a fluid dispensing nozzle construction comprising a valve body having a dispensing spout extending therefrom, and a flexible bellows-like tube of polymeric material telescopically disposed on the spout and having opposed ends one of which is secured to the valve body and the other of which carries a face seal means for engaging an annular lip of a fill pipe of a fluid storage tank to seal around an opening in the fill pipe when the spout is inserted therein, the spout and the tube defining a vapor recovery passage therebetween that leads from the seal means to the valve body. The spout has a valve seat member thereon and the tube carries a valve member that moves therewith and that cooperates with the valve seat member to close the passage intermediate the seal means and the valve body when the tube is in a certain first compressed condition thereof between the seal means and the valve body and to open the passage when the tube is in a certain greater compressed condition thereof between the seal means and the valve body. For example, see the U.S. Pat. No. 4,557,302 to Sunderhaus.

Also see the U.S. Pat. No. 4,286,635 to McMath, wherein the valve means for the vapor recovery passage is provided at the face seal means of the bellows-like tube.

SUMMARY OF THE INVENTION

It is one features of this invention to provide new valve means in the vapor recovery passage of a fluid dispensing nozzle construction so that the valve means will uniquely close the passage when the flexible bellows-like tube thereof is in a certain first compressed condition thereof and will open the passage when the tube is in a certain greater compressed condition thereof.

In particular, it was found according to the teachings of this invention that the valve means of the fluid dispensing nozzle construction in the vapor recovery passage thereof can comprise an internal annular surface on the tube valve member that will slide over at least part of the valve seat member that is carried by the dispensing spout of the nozzle construction. This arrangement readily permits the flexible bellows-like tube to act as the sole spring means for providing the necessary sealing force without requiring a metallic compression spring as in the aforementioned two U.S. patents. Thus, the seal arrangement of this invention requires less force by the user of the nozzle construction to open the seal means during a fluid dispensing operation than the force required by the prior known nozzle construction.

Accordingly, one embodiment of this invention provides a fluid dispensing nozzle construction that comprises a valve body having a dispensing spout extending therefrom, and a flexible bellows-like tube of polymeric material disposed on the spout and having opposed ends one of which is secured to the valve body and the other of which carries a face seal means for engaging an annular lip of a fill pipe of a fluid storage tank to seal around an opening in the fill pipe when the spout is inserted therein, the spout and the tube defining a vapor recovery passage therebetween that leads from the seal means to the valve body. The spout has a valve seat member thereon and the tube carries a valve member that moves therewith and that cooperates with the valve seat member to close the passage intermediate the seal means and the valve body when the tube is in a certain first compressed condition thereof between the seal means and the valve body and to open the passage when the tube is in a certain greater compressed condition thereof between the seal means and the valve body. The valve member has an internal annular surface that slides over at least part of the valve seat member in sealing engagement therewith to close the passage when the tube is in the first compressed condition thereof.

Therefore, it is an object of this invention to provide a new fluid dispensing nozzle construction having one or more of the novel features of this invention as set forth above or hereinafter shown or described.

Another object of this invention is to provide a new method of making a fluid dispensing nozzle construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
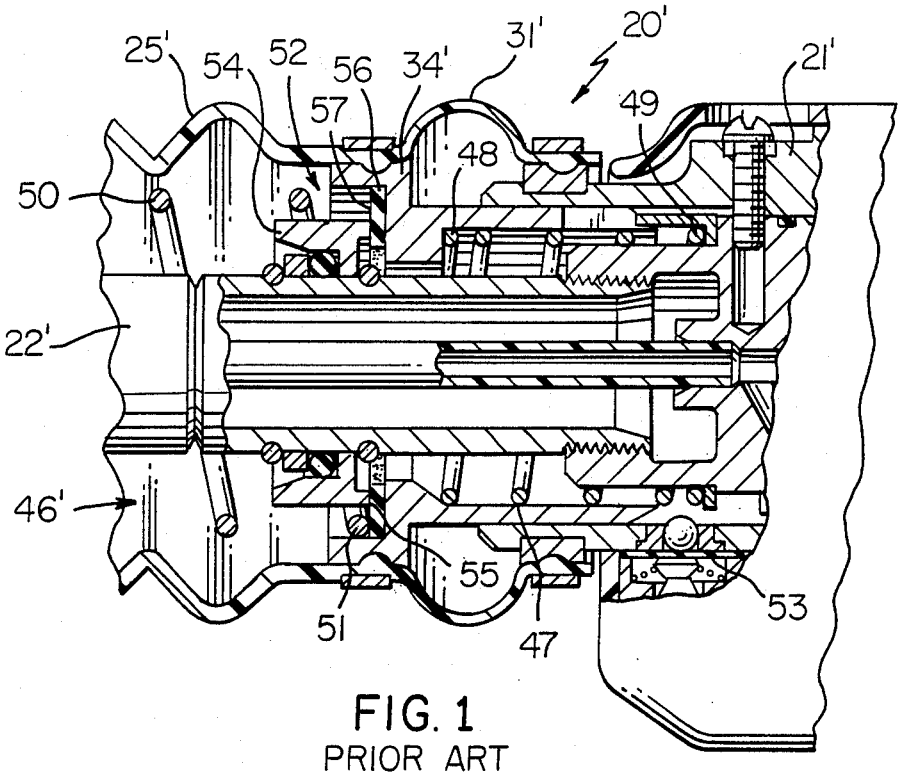
FIG. 1 PRIOR ART
FIG. 1 is a fragmentary cross-sectional view of a prior known vapor check valve means in the vapor recovery passage of a prior known fluid dispensing nozzle construction, FIG. 1 illustrating the check valve means in the closed condition thereof.

While the various features of this invention are hereinafter illustrated and described as being particularly adapted to provide a nozzle constrution for dispensing fuel into the fill pipes of the gasoline storage tanks on automobiles and the like at conventional filling stations and the like wherein the nozzle construction is hand operated in a manner well known in the art, it is to be understood that the various features of this invention can be utilized singly or in various combinations thereof to provide nozzle constructions for dispensing other fluids as desired.

Therefore, this invention is not to be limited to only the embodiments illustrated in the drawings, because the drawings are merely utilized to illustrate one of the wide variety of uses this invention.

Figure 3:
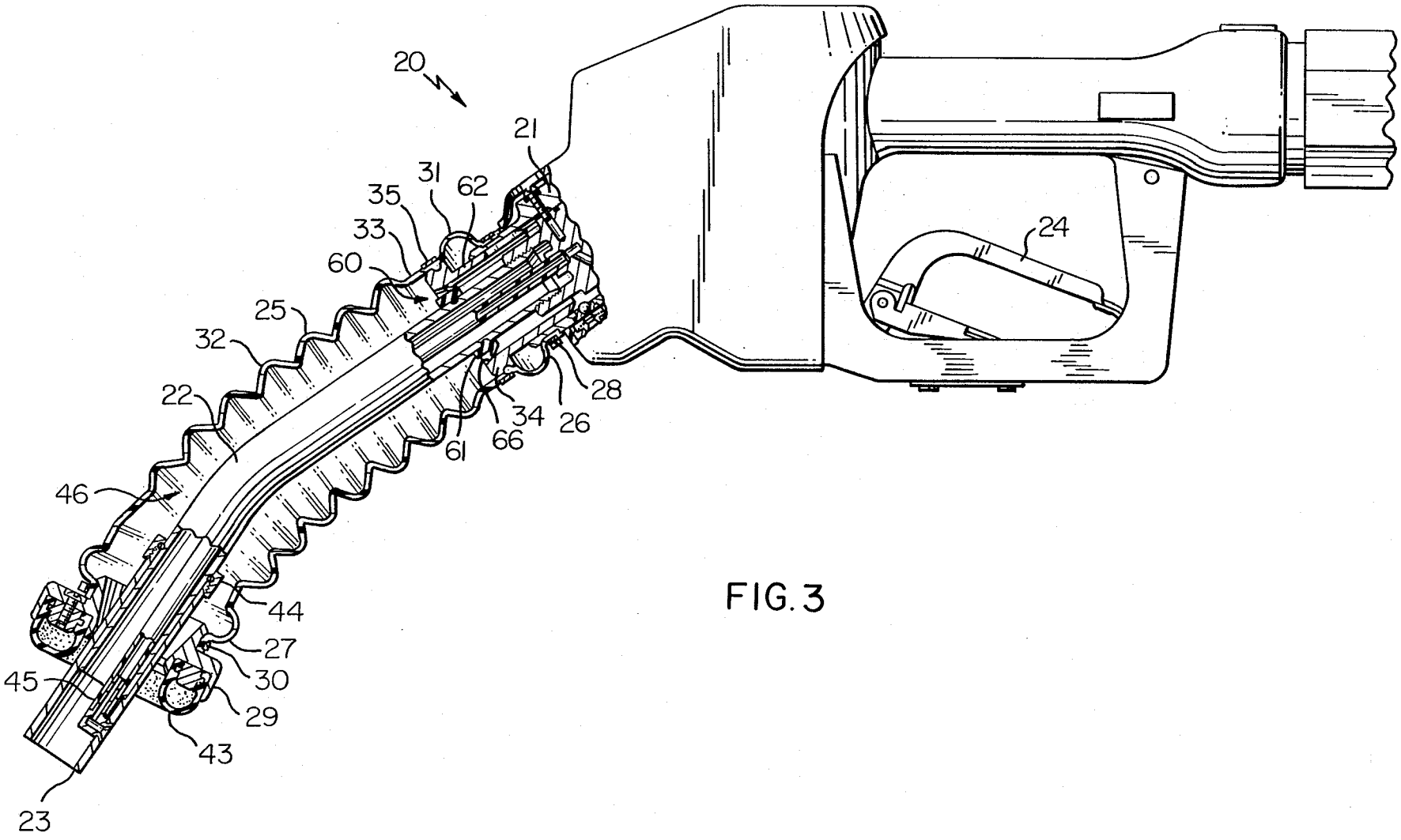
FIG. 3 is a side view of a new fluid dispensing valve construction of this invention with certain parts thereof being shown in cross section.

Referring now to FIG. 3, the new fluid dispensing nozzle construction of this invention is generally indicated by the reference numeral 20 and comprises a valve body 21 having a dispensing spout 22 extending therefrom for dispensing fluid out of an open end 23 of the spout 22 when an operating lever 24 of the nozzle construction 20 is operated in a conventional manner and the valve body 21 is interconnected to a source of fluid by an interconnecting hose construction (not shown).

The fluid dispensing nozzle construction 20 also includes a flexible bellows-like tube 25 formed of any suitable polymeric material, such as urethane, and telescopically disposed on the spout 22 in substantially concentrically spaced relation therefrom, the tube 25 having opposed ends 26 and 27 with the end 26 being secured to the valve body 21, such as by an annular clamp 28 in a manner conventional in the art, and with the other end 27 being secured to a face seal means 29 in any suitable manner, such as by an annular clamp 30 also in a manner conventional in the art.

The tube 25 has an annular convolution 31 adjacent the upper end 26 thereof and being separated from a plurality of annular body convolutions 32 by an annular section 33 of the tube 25 that is non-convoluted. The section 33 of the tube 25 is interconnected to a movable actuator 34 of the nozzle construction by being clamped thereto by an annular clamp 35 in a manner conventional in the art so as to move the actuator 34 toward the valve body 21 when the spout 22 is being inserted into an opening 36, FIG. 4, of a fill pipe 37 because the tube 25 is being compressed between the valve body 21 and the fill pipe 37 for the reasons fully set forth in the aforementioned two U.S. patents, the U.S. Pat. No. 4,286,635 to McMath, and the U.S. Pat. No. 4,557,302 to Sunderhaus, whereby these two U.S. patents are being incorporated into this disclosure by this reference thereto.

Therefore, since the general operation of the fluid dispensing nozzle construction 20 and the use of the bellows-like tube 25 both as a vapor recovery means and as a spring force means for operating an actuator 34 is well known in the art, as evidenced by the aforementioned two U.S. patents, only the features thereof that are necessary to understand the features of this invention will be hereinafter set forth.

Figure 4:
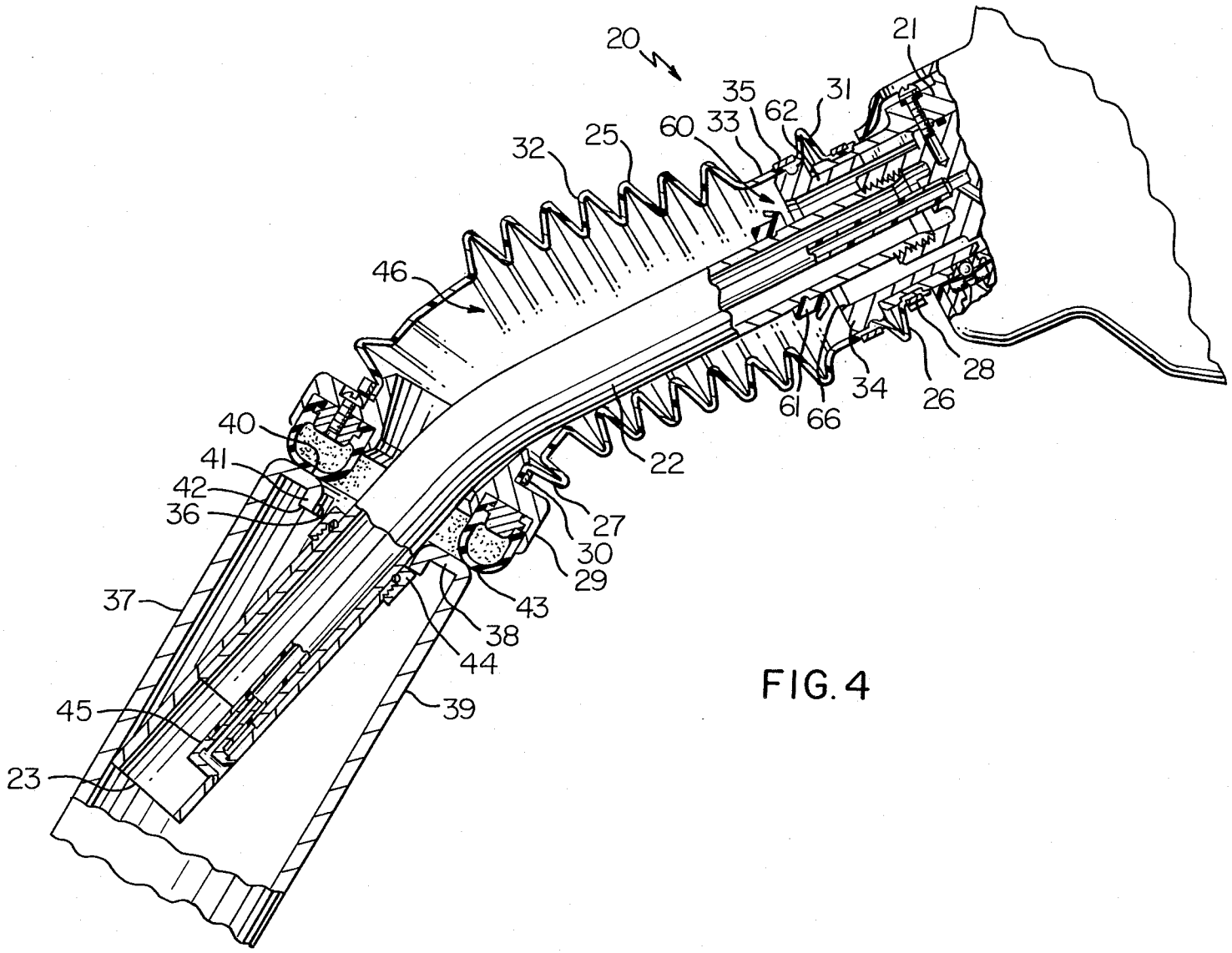
FIG. 4 is an enlarged view similar to FIG. 3 and illustrates the fluid dispensing nozzle construction of FIG. 3 when the same has been fully inserted in a fill pipe of a fluid storage tank to dispense fluid therein.

As illustrated in FIG. 4, the fill pipe 37 has an annular lip 38 surrounding the opening 36 thereof and joining with an external side wall means 39 thereof whereby the annular lip 38 provides a substantially flat annular outer surface 40, the fill pipe 37 having an inwardly turned axial section 41 defining the opening 36 thereof and an annular abutment means 42 for a purpose hereinafter described.

The seal means 29 carried on the lower end 27 of the tube 25 has a face seal means 43 formed of flexible sealing material, such as any suitable polymeric material, that is adapted to engage against the flat surface 40 of the lip 38 of the fill pipe 37 as the spout 22 has its end 23 being inserted into the opening 36 in a conventional manner.

The face seal 43 of the seal means 29 seals completely around the opening 36 of the fill pipe 37 in the manner illustrated in FIG. 4 even when the spout 22 has been fully inserted into the fill pipe 37 and the valve body 21 is tilted downwardly so that an annular abutment means 44 of the spout 22 engages against the abutment means 42 of the fill pipe 37 so that the operator of the nozzle construction 20 can release the nozzle construction 20 and the nozzle construction 20 will continue to remain in the position illustrated in FIG. 4 and dispense fuel into the fill pipe 37 because the actuating lever 24 thereof has been latched in a dispensing position thereof in a manner conventional in the art. Such a nozzle construction 20 has means 45 for automatically turning off the fluid flow through the nozzle construction 20 from such a fluid dispensing operation when the level of fuel in the fill pipe 37 has reached a certain level in a conventional manner.

During such fluid dispensing operation with the nozzle construction 20, it is intended that the vapors of fuel not only being dispensed by the nozzle construction 20, but also issuing from the fuel being stored in the storage compartment (not shown) to which the fill pipe 37 leads, are to be prevented from reaching the atmosphere by the annular seal means 29 sealing on the rim 38 of the fill pipe 37 and are to be withdrawn from the fill pipe 37 through the space or passage 46 between the spout 22 and the tube 25 back through the nozzle construction 20 by a conventional vapor recovery system as set forth in the aforementioned two U.S. patents.

However, such nozzle constructions normally have a vapor check valve means therein that will automatically close the vapor recovery passage between the tube and dispensing spout thereof when the nozzle construction is in a non-dispensing condition thereof so to prevent the releasing of the vapors from the vapor recovery system into the atmosphere, the vapor check valve means automatically opening when the nozzle construction has been inserted into the opening of a fill pipe a certain amount.

Figure 2:
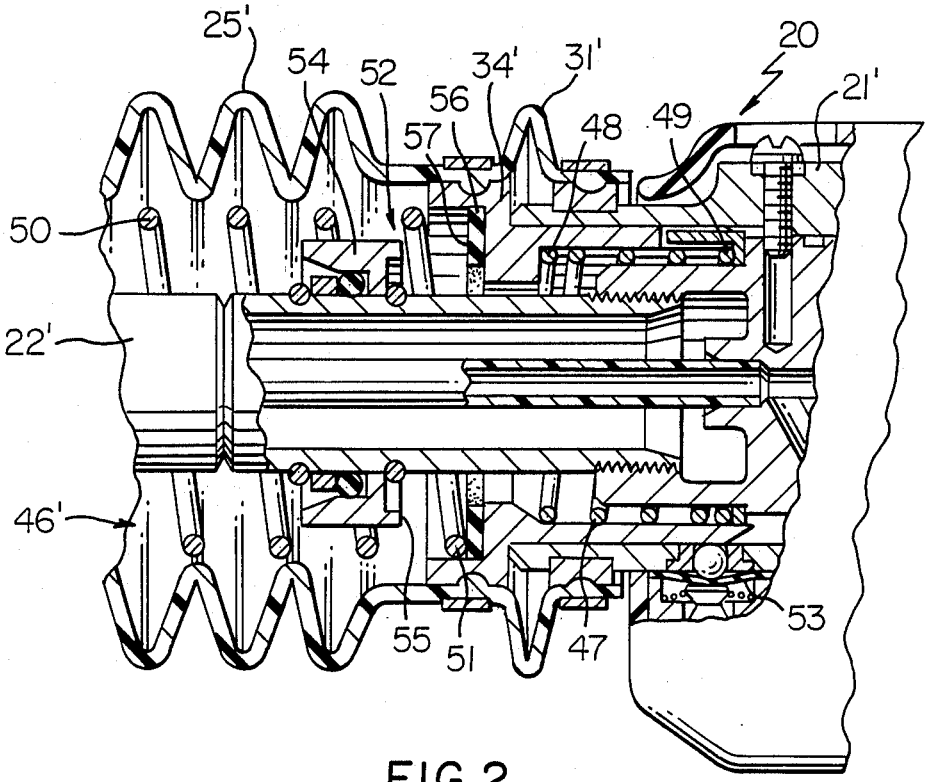
FIG. 2 PRIOR ART
FIG. 2 is a view similar to FIG. 1 and illustrates the check valve means in an open condition thereof.

For example, FIGS. 1 and 2 illustrate the check valve means of the aforementioned U.S. Pat. No. 4,557,302 to Sunderhaus, and such structure will now be described in order to best understand the various features of this invention.

As illustrated in FIGS. 1 and 2, the prior known fluid dispensing nozzle construction is generally indicated by the reference numeral 20' and parts thereof similar to the nozzle construction 20 previously described are indicated by the like reference numerals follows by a prime mark.

As illustrated in FIGS. 1 and 2, the actuator 34' that is carried inside the bellows tube 25' is normally urged to the left in the drawings by a compression spring 47 having one end 48 bearing against the actuator 34' and the other end 49 thereof effectively bearing against the value body 21'. A large compression spring 50 is telescopically disposed on the spout 22' and has one end 51 bearing against the actuator 34' while the other end (not shown) in effect bears against the seal means at the other end of the bellowslike tube 25'. The spring 50 is so constructed and arranged that the same will not overcome the force of the spring 47 until after the spout 22' has been inserted into a fill pipe a certain amount and thereby cause the actuator member 34' to move from the position illustrated in FIG. 1 to the position illustrated in FIG. 2 by compressing the convolution 31' of the bellows tube 25'. In this manner, not only is a check vapor valve means 52 of the nozzle construction 20' that is disposed in the vapor recovery passage 46' opened by the actuator 34', but also the actuator 34' actuates a diaphragm 53 of the valve body 21' for the purpose fully set forth in the aforementioned U.S. Pat. No. 4,286,635 to McMath, whereby the structure and operation of the diaphragm 53 under the control of the actuator 34' need not be further set forth in this application.

However, the check valve means 52 comprises a valve seat member 54 that is fixed to the spout 22' and has an annular face valve seat 55. The actuator 34' carried by the tube 25' comprises a movable valve member and carries a resilient annular ring 56 that has a flat annular face 57 for directly engaging against the annular valve seat surface 55 to close the vapor recovery passage 46' when the valve member 34' is disposed in the position illustrated in FIG. 1 wherein the spout 22' has not been inserted into the fill pipe a distance sufficient to compress the spring 50 by an amount necessary to overcome the force of the spring 50 by an amount necessary to overcome the force of the spring 47. However, when the spring 50 has been compressed sufficiently, the force thereof overcomes the force of the spring 47 and moves the valve member 34' out of sealing engagement with the valve seat 55 to open the vapor recovery passage 46' for the purpose of recovering vapors as fully set forth in the aforementioned two U.S. patents.

As previously stated, it was found according to the teachings of this invention that in order to make sure that the poppet valve member 34' of the nozzle construction 20' fully seals around the annular valve seat 55 to fully close the vapor check valve means 52, the spring 47 must be relatively strong. However, it was also found that because the spring 47 is relatively strong, the user of the nozzle construction 20' must exert a larger amount of force to fully insert the spout 22' of the nozzle construction 20' in the fill pipe in order to properly open the vapor check valve 52.

Accordingly, one of the features of this invention is to eliminate the spring 47 and still provide an effective vapor check valve means for the nozzle instruction and this feature is accomplished by the unique vapor check valve means of this invention.

In particular, it was found according to the teachings of this invention that the axial moving action of the actuator 34' of the prior known fluid dispensing nozzle construction 20' could be utilized to provide a sliding sealing action which would not require the strong spring force and would compensate for any tolerance errors so that the check valve means would remain closed until the face seal means of the bellows-like tube was being held in full sealing relation against the lip or the fill pipe so as to prevent the escape of the vapors into the atmosphere.

Figure 5:
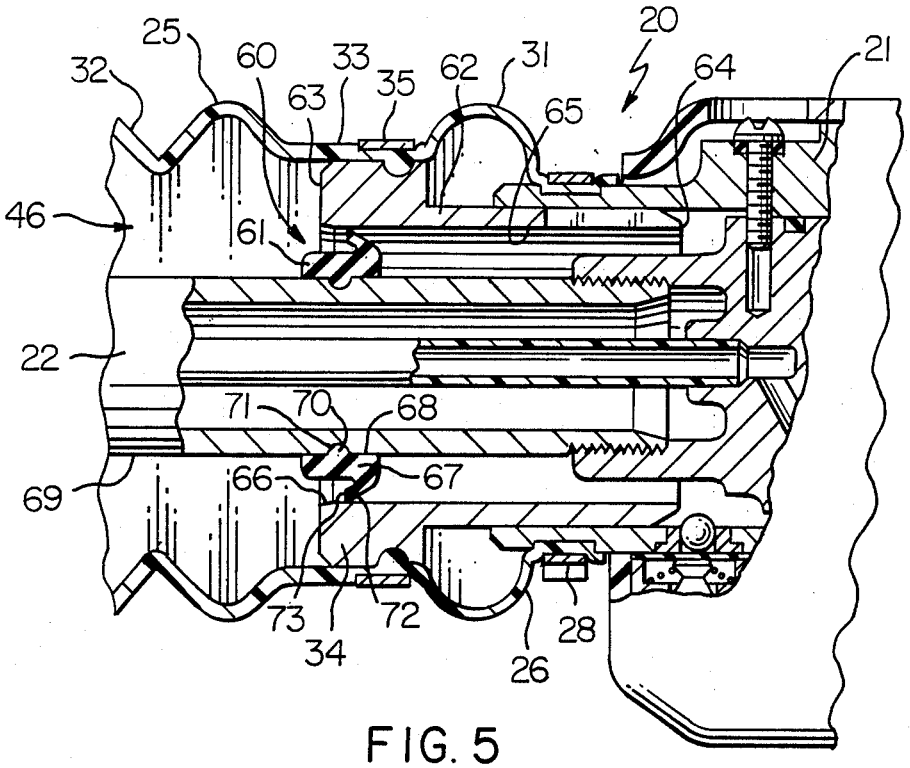
FIG. 5 is an enlarged fragmentary cross-sectional view of the nozzle construction illustrated in FIGS. 3 and 4 and illustrates the valve means thereof in a closed condition thereof.
Figure 6:
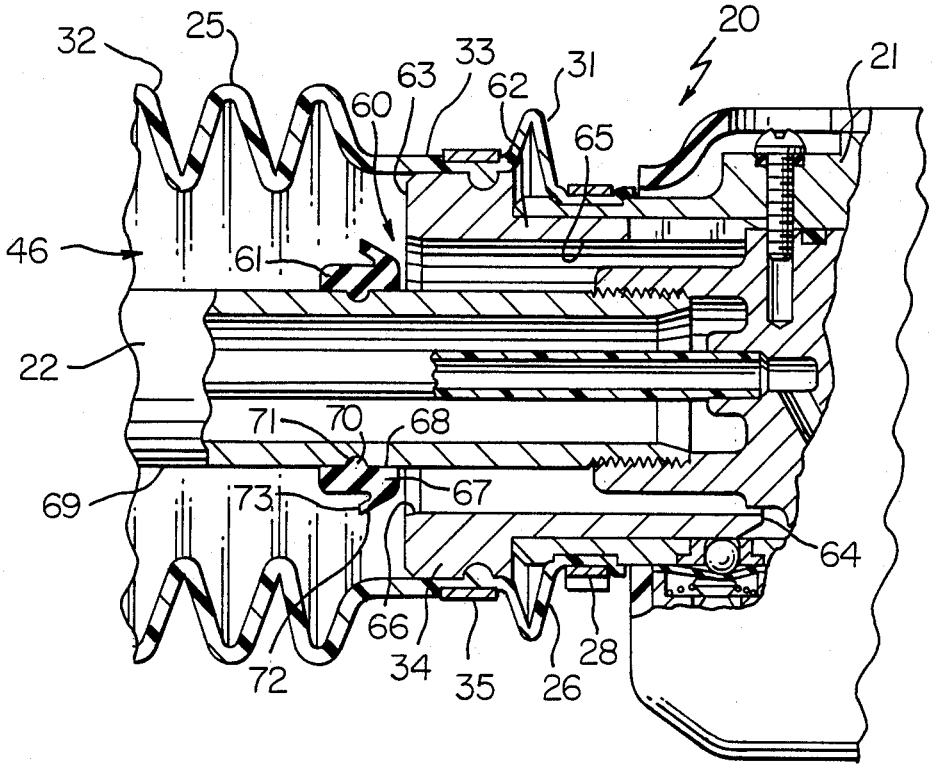
FIG. 6 is a view similar to FIG. 5 and illustrates the valve means in an open position thereof.

Accordingly, reference is again made to FIGS. 3 and 4, as well as to FIGS. 5 and 6, wherein the parts of the nozzle construction 20 of this invention that are similar to the parts of the prior known nozzle construction 20' previously described are indicated by like reference numerals.

The new check valve means of the nozzle construction 20 of this invention is generally indicated by the reference numeral 60 and comprises a valve seat 61 carried by the spout 22 and the valve member 34 that is carried by the tube 25 to move in unison therewith and is also utilized to operate the previously described diaphragm 53 of the nozzle construction 20.

The valve member 34 can be formed of any suitable material and in the embodiment illustrated in FIGS. 3–6 comprises a metallic material having a tubular position 62 provided with opposed open ends 63 and 64 with an annular internal peripheral surface 65 therebetween which defines a cylinder that has a substantially circular transverse cross-sectional configuration throughout the length thereof except at adjacent the open end 63 thereof wherein an annular beveled or camming surface 66 is provided for a purpose hereinafter set forth.

The valve seat member 61 can be formed of any suitable flexible or resilient material and in the embodiment illustrated in FIGS. 3–6 comprises polymeric material shaped or molded to provide an annular body portion 67 having an internal peripheral surface 68 that is adapted to be pressfitted onto the external peripheral surface 69 of the spout 22 and be held in a certain position thereon by having an inwardly directed annular bead 70 thereof received in an annular groove 71 formed in the spout 22 as illustrated. In this manner, the valve seat member 61 is not only fixed from movement on the spout 69, but also seals to the spout 22 and can be readily replaced if desired by merely stretching the member 61 to pull the projection 70 out of the groove 71 and then have the annular body member 67 slipped off the spout 22 at the end 23 thereof so that a new valve seat member 61 can be replaced thereon in the manner previously set forth.

The valve seat member 61 has an outwardly directed annular lip 72 formed integrally with the body portion 67 and having a free end 73, the lip 72 initially extending outwardly from the body portion 67 a certain distance so that the outer end 73 of the lip 72 will be placed in inward compression by the internal annular surface 65 of the valve member 34 when the lip 72 is disposed in the valve member 34 as illustrated in FIGS. 3 and 5. In this manner, the lip 72 is placed in and held in annular sealing relation with the internal annular surface 65 of the valve member 34 so as to completely seal closed the vapor recovery passage 46 at a point intermediate the face seal means 43 and the valve body 21 when the tube 25 is in the condition illustrated in FIG. 3.

However, when the nozzle construction 20 has the spout 22 thereof initially inserted into the opening 36 of the fill pipe 37 so that the face seal means 43 engages against the flat surface 40 of the lip 38 and thereby permits the convolutions 32 of the tube 25 to begin to be compressed between the lip 38 of the fill pipe 37 and the valve body 21 as the valve body is being moved further toward the fill pipe 37, such compressed condition of the convolutions 32 of the tube 25 eventually reaches a first compressed condition thereof that just begins to axial move the valve member 34 toward the valve body 21 by collapsing the convolution 31 of the tube 25 that is disposed between the clamps 28 and 35. As the bellows-like tube 25 is further compressed by the further insertion of the spout 22 into the fill pipe 37, the valve member 34 is axially moved further toward the valve body 21 to not only actuate the diaphragm 53 for the reasons previously set forth, but also to have the end 63 of the tubular portion 62 of the valve member 34 move to the right beyond the free end 73 of the lip 72 of the valve seat member 61 in the manner illustrated in FIG. 6 to fully open the check valve means 60 and, thus, to fully open the vapor recovery passage 46 so that the vapors that are trapped between the face seal means 43 and the fill pipe 37 can be returned through the passage 46 and the valve body 21 by the operation of the conventional vapor recovery system interconnected thereto.

Thus, it can be seen that when the spout 22 of the nozzle construction 20 has been fully inserted into the fill pipe 37 so as to hook the abutment 44 thereof against the abutment 42 of the fill pipe 37 as illustrated in FIG. 4, the check valve means 60 will remain in an open condition during the entire time that the fluid is being dispensed by the nozzle construction 20 into the fill pipe 37.

Thereafter, when the user disconnects the spout abutment 44 from the abutment 42 of the fill pipe 37 and begins to withdraw the spout 22 from the opening 36 in the fill pipe 37, the tube 25 begins to expand and thereby permits the collapsed convolution 31 to also expand and, through the spring force of the convolution 31, move the valve member 34 toward the valve seat member 61 and have the camming surface 66 thereof subsequently cam against the lip 72 to permit the lip 72 to fully enter into the valve member 34 and seal against the internal annular peripheral surface 65 therof in a manner to fully close the check valve means 60 and, thus, close the vapor recovery passage 46. Such closing of the check valve means 60 and vapor recovery passage 46 takes place before the face seal means 43 releases from its sealing relation with lip 38 of the fill pipe 37.

Accordingly, it can be seen that because the lip seal means 72 seals against the internal annular peripheral surface 65 of the valve member 34 in all axial positions therein, the tolerances for making the various parts of the spout 22 and tube 25 can be relatively large and still provide the sealing and unsealing function of the check valve means 60 to trap and recover the vapors during a fluid dispensing operation of the nozzle construction 20 of this invention.

Also, it can be seen that the larger spring 50 of the prior known nozzle construction 20' can be eliminated along with the elimination of the spring 47 thereof as the spring force of the body convolutions 32 of the tube 25 provide all the force that is necessary to seal the face seal means 43 against the lip 38 of the fill pipe 37.

While the valve seat member 61 can be formed of any suitable material and be of any suitable size, one working embodiment thereof was formed of a 60 durometer viton that was sold under the designation M-19 by the Precision Rubber Companying of Tempe, Ariz. and had a width of approximately ⅜ of an inch, an inside diameter of the body portion 67 thereof of approximately 0.800 of an inch, an outside diameter of the body portion 67 thereof of approximately 1 1/16 of an inch, an outside diameter of the free end 73 of the lip 72 of approximately 1.312 of an inch, a thickness of the lip 72 of approximately 3/64 of an inch, and with the lip 72 making an angle of approximately 30 degrees with the longitudinal axis of the seat member 61 and having a length of approximately 0.218 of an inch.

Of course, it is to be understood that the above dimensions, etc. of the one working embodiment of the valve seat member 61 are merely set forth for the purpose of information and are not to be a limitation on this invention.

While the valve seat member 61 previously described has the annular lip 72 thereof angled in such a manner that it faces away from the open end 63 of the valve member 34 when the same are disposed in the open condition illustrated in FIG. 6, it is to be understood that the lip means 72 could face toward the open end 63 of the valve seat means 34 when the same are disposed in the open condition thereof if desired.

Figure 7:
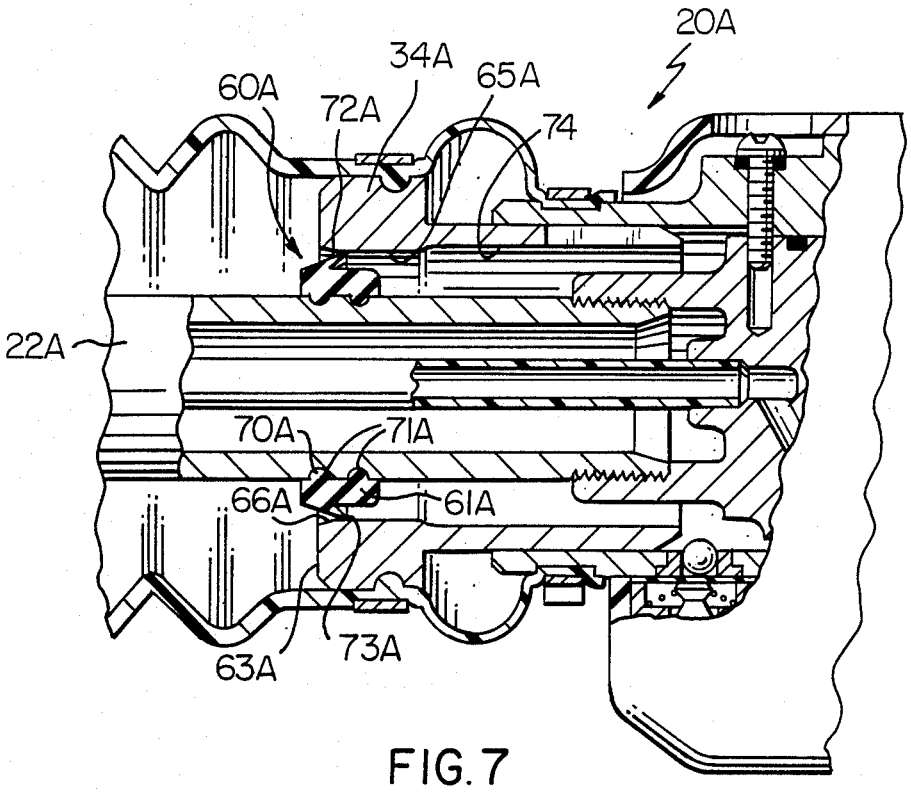
FIG. 7 is a view similar to FIG. 5 and illustrates another valve means of this invention.
Figure 8:
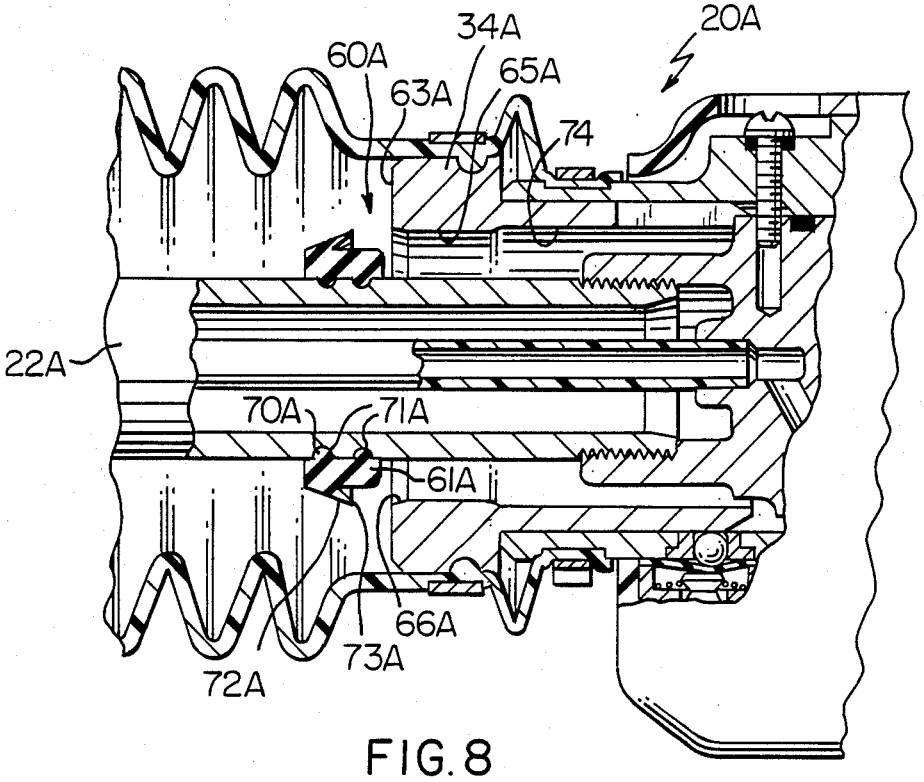
FIG. 8 is a view similar to FIG. 7 and illustrates the valve means FIG. 7 in an open condition thereof.

For example, another fluid dispensing nozzle construction of this invention is generally indicated by the reference numeral 20A in FIGS. 7 and 8 and parts thereof similar to the nozzle construction 20 previously described are indicated by like reference numerals followed by the reference letter "A".

As illustrated in FIGS. 7 and 8 the check valve means 60A of the nozzle construction 20A comprises the valve member 34A formed in the same manner as the valve member 34 previously described and the valve seat member 61A is formed in substantially the same manner as the valve seat member 61 previously described except that the lip 72A thereof projects in the opposite direction so as to face the open end 63A of the tubular valve member 34A when the check valve means 60A is disposed in the open condition as illustrated in FIG. 8.

In addition, the valve seat member 61A is provided with a plurality of annular projections 70A disposed in spaced apart relation and being respectively received in annular grooves 71A in the spout 22A to firmly fasten the valve seat member 61A thereto as well as to seal the valve seat number 61A to the spout 22A.

It can readily be seen that when the valve member 34A moves to the left from the open position of FIG. 8 to its closed position as illustrated in FIG. 7, the camming surface 66A of the open end 63A acts on the end 73A of the lip 72A to cam the same into the valve member 34A so as to be disposed in radially inwardly compressed relation against the internal annular surface 65a for its sealing function therewith as previously described.

If desired, the valve member 34A can form the sealing surface 65A with a step 74 therein since the step 74 is sufficiently spaced from the sealing area of the surface 65A which is of sufficient length to permit full sealing even while compensating for tolerance variations.

Since the operation of the nozzle construction 20A is substantially identical to the operation of the nozzle construction 20 previously described, a further description of the operation of the nozzle construction 20A need not be set forth.

Figure 9:
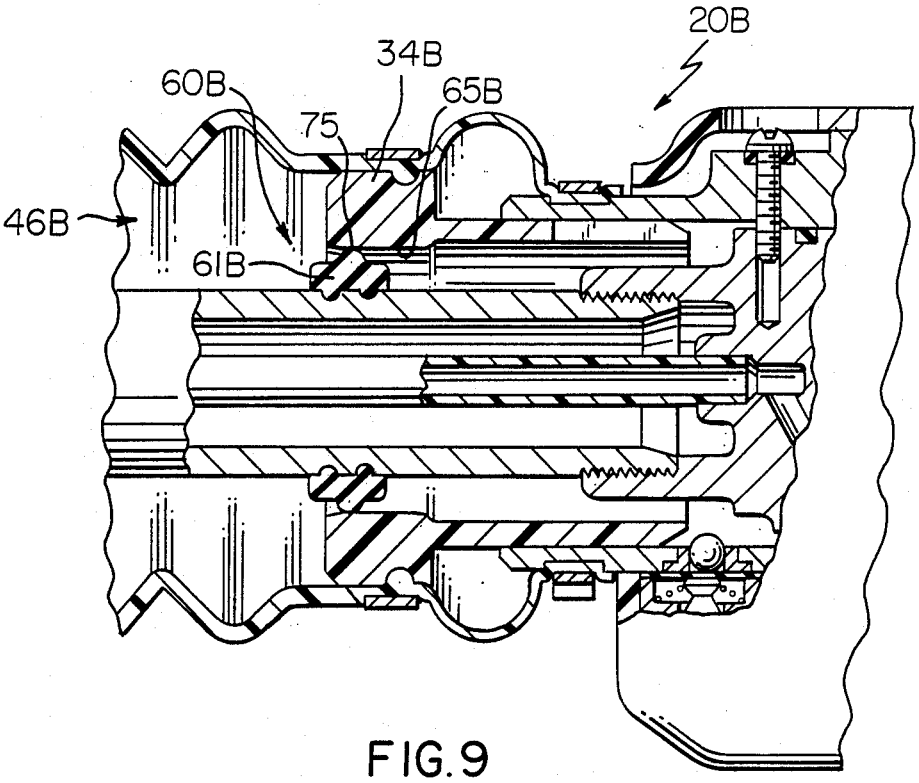
FIG. 9 is a view similar to FIG. 5 and illustrates another valve means of this invention.
Figure 10:
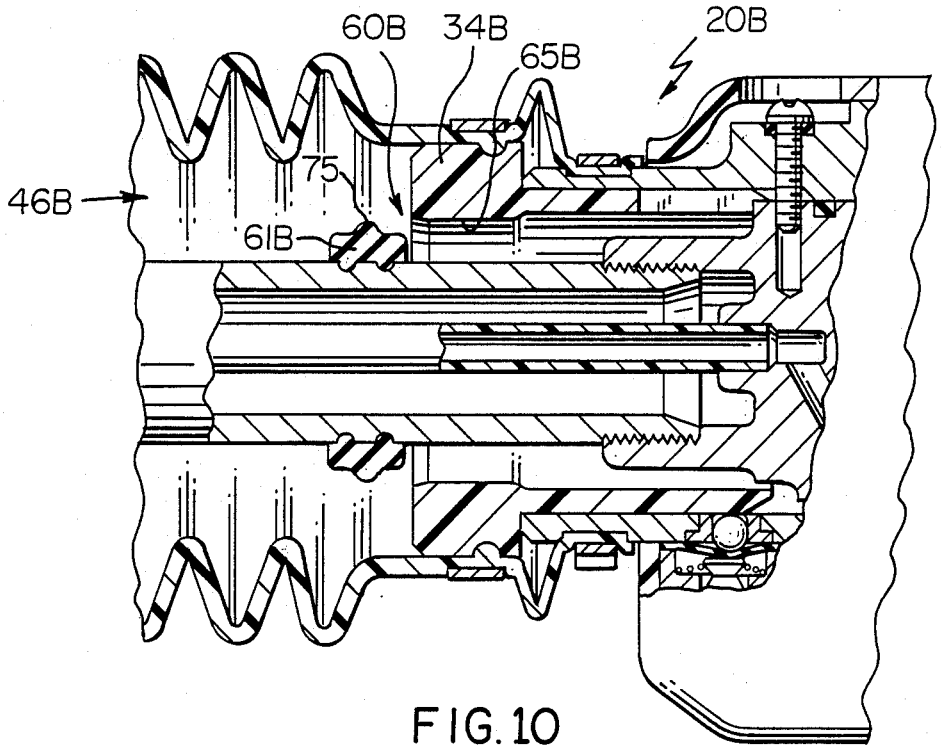
FIG. 10 is a view similar to FIG. 9 and illustrates the valve means of FIG. 9 in an open condition thereof.

Another fluid dispensing nozzle construction of this invention is generally indicated by the reference numeral 20B in FIGS. 9 and 10 and parts thereof similar to the nozzle constructions 20 and 20A previously described are indicated by like reference numerals followed by the reference letter "B".

The valve member 34B of the check valve means 60B of the nozzle construction 20B is formed in the same manner as the valve member 34A previously described except that the same is formed of flexible or resilient material, such as polymeric material.

The valve seat member 61B of the nozzle construction 20B is also formed of flexible or resilient material in the same manner as the valve seat member 61A previously described except that instead of having an annular lip angled therefrom, the valve seat member 61A has an annular bead 75 extending centrally and radially therefrom and defining a semi-circular transverse cross-sectional configuration with the bead 75 being disposed in radially inwardly compressed relation when the same is disposed in the valve member 34B in sealing relation against the internal peripheral surface 65B thereof as illustrated in FIG. 9.

FIG. 10 illustrates how the valve member 34B is spaced to the right of the valve seat member 61B to open the check valve means 60B and, thus, the vapor recovery passage 46B for the reasons previously set forth.

In this manner, not only is the valve seat member 61B placed into inward radial compression when the check valve means 60B is disposed in a closed condition thereof as illustrated in FIG. 9, but also the valve member 34B has the internal annular peripheral surface 65B thereof placed in outwardly directed radial compression when the check valve means 60B is in the closed condition as illustrated in FIG. 9.

Figure 11:
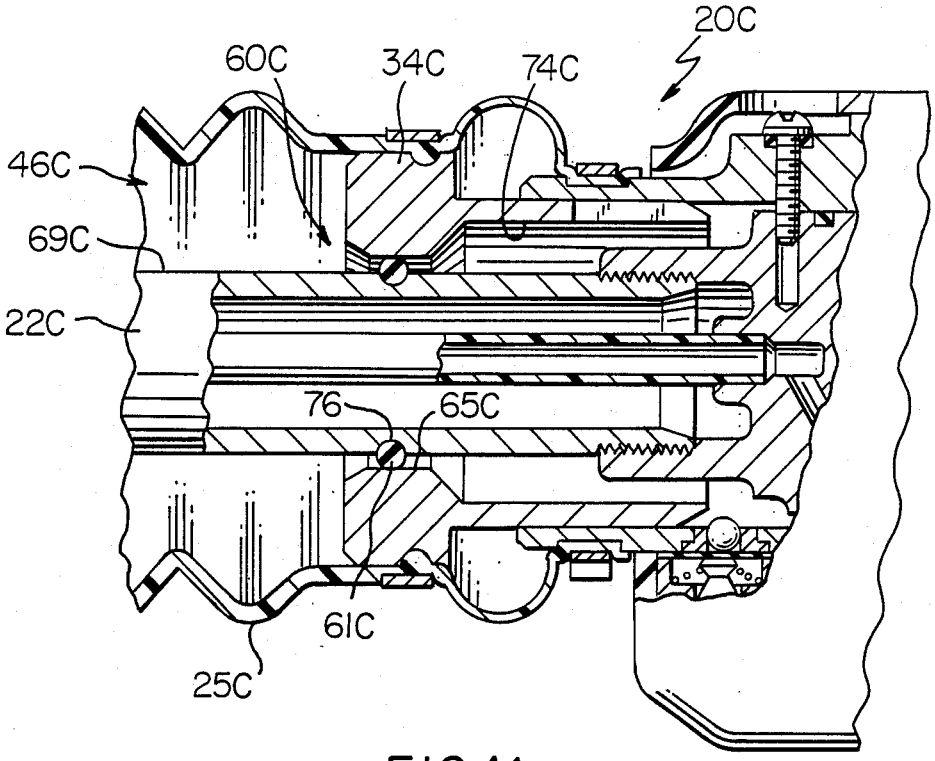
FIG. 11 is a view similar to FIG. 5 and illustrates another valve means of this invention.
Figure 12:
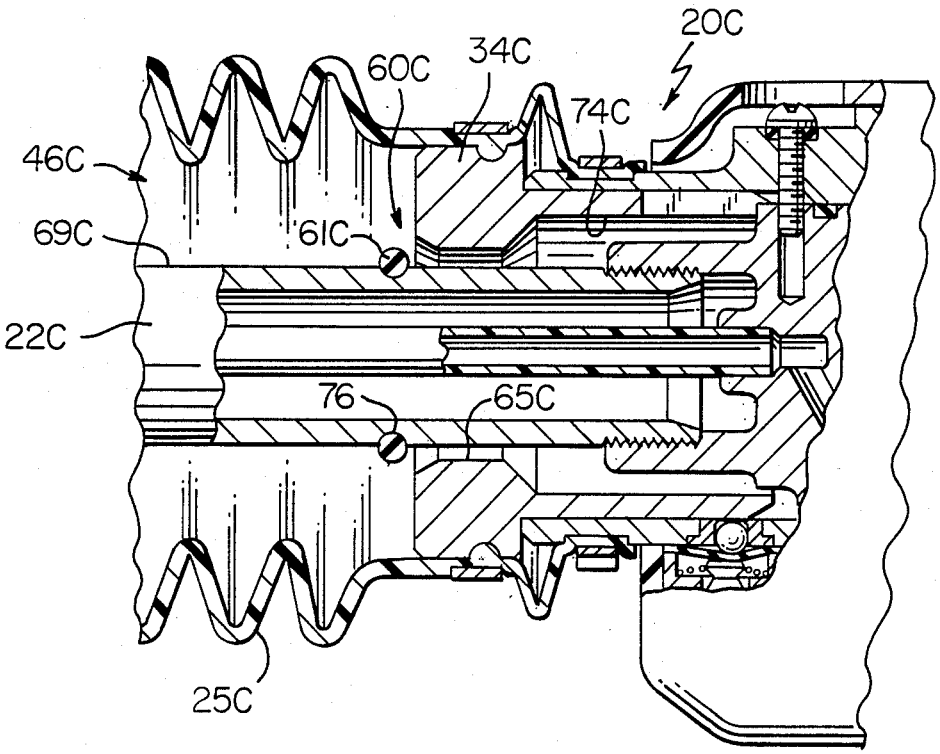
FIG. 12 is a view similar to FIG. 11 and illustrates the valve means of FIG. 11 in an open condition thereof.

Another fluid dispensing nozzle construction of this invention is generally indicated by the reference numeral 20C in FIGS. 11 and 12 and the parts thereof that are similar to like parts of the nozzle constructions 20, 20A and 20B previously described are indicated by like reference numerals followed by the reference letter "C".

As illustrated in FIGS. 11 and 12, the valve member 34C of the nozzle construction 20C that is carried by the tube 25C is formed in substantially the same manner as the valve member 34A previously described except that the offset 74C thereof is greater as the internal annular peripheral surface 65C is disposed closer to the external pheripheral surface 69C of the spout 22C.

The valve seat member 61C of the check valve means 60C of the nozzle construction 20C merely comprises an annular flexible O-ring-like member formed of any suitable polymeric material and having the inner portion thereof disposed in an annular groove 76 of the spout 22C so as to hold the valve member 61C thereto. If desired, the valve seat member 61C could be in a stretched condition even when the same is disposed in the groove 76 of the spout 22C.

In this manner, it can be seen that the outer portion of the O-ring-like member 61C fully seals against the internal peripheral surface 65C of the valve member 34C when disposed in the closed condition of FIG. 11 wherein the O-ring-like member 61C is disposed in radially inwardly compressed relation by the surface 65C to fully close the check valve means 60C and, thus, the vapor recovery passage 46C.

However, the vapor recovery passage 46C is adapted to be readily opened in the manner illustrated in FIG. 12 when the valve member 34C moves to the right beyond the valve seat member 61C in the manner previously set forth.

Figure 13:
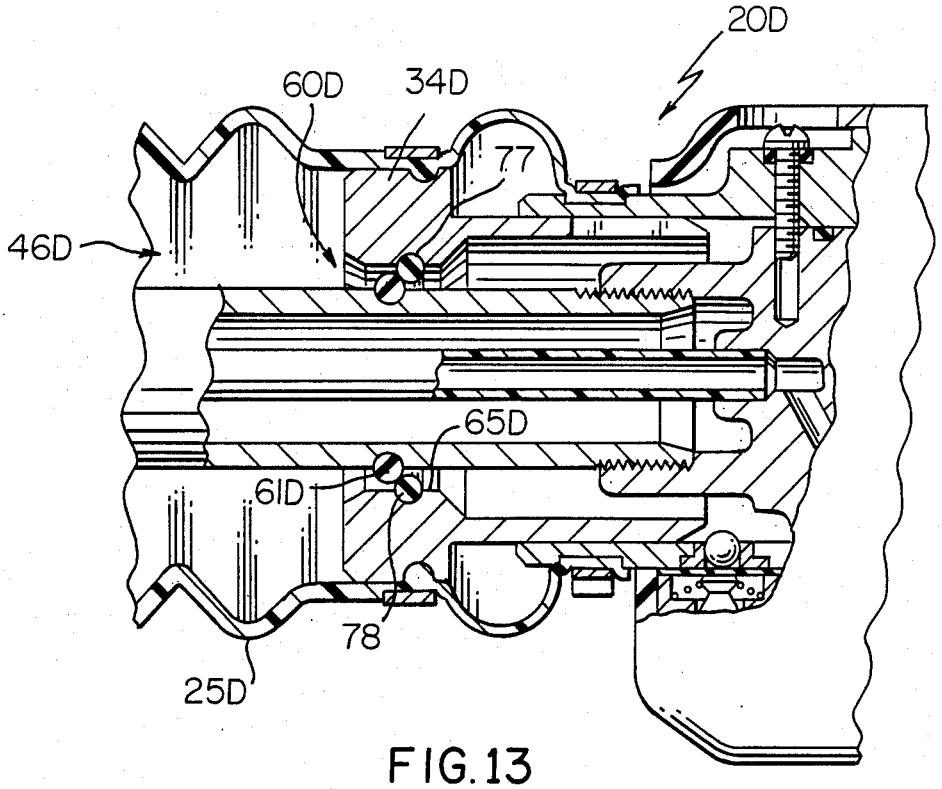
FIG. 13 is a view similar to FIG. 5 and illustrates another valve means of this invention.
Figure 14:
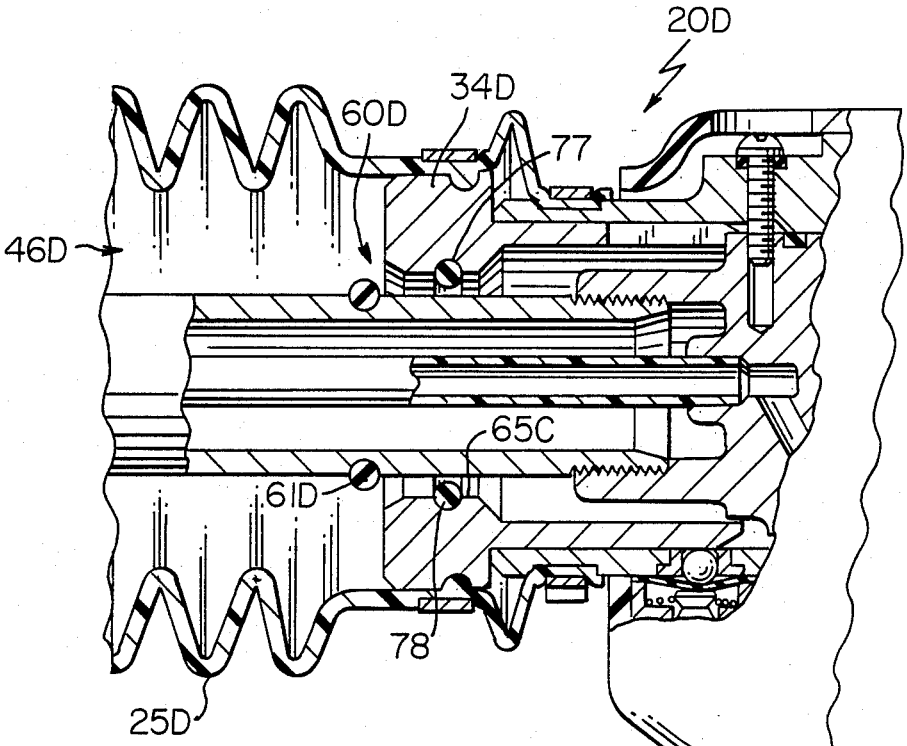
FIG. 14 is a view similar to FIG. 13 and illustrates the valve means of FIG. 13 in an open condition thereof.

Another fluid dispensing nozzle construction of this invention is generally indicated by the reference numeral 20D in FIGS. 13 and 14 and parts thereof similar to like parts of the nozzle constructions 20, 20A, 20B and 20C previously described are indicated by like reference numerals followed by the reference letter "D".

As illustrated in FIGS. 13 and 14, the check valve means 60D of the nozzle construction 20D has the valve seat member 61D formed in the same manner as the valve seat member 61C previously described.

However, the valve member 34D of the tube 25D of the nozzle construction 20D has an annular groove 77 formed in the internal annular peripheral surface 65D thereof and receives the outer portion of an annular O-ring-like member 78 therein that has the inner portion thereof projecting radially inwardly from the internal peripheral surface 65D in such a manner that the O-ring-like member 78 is adapted to slide against the O-ring 61D to close the check valve means 60D to the manner illustrated in FIG. 13.

Thus, it can be seen that the valve member 34D of the nozzle construction 20D has the O-ring member 78 thereof slide over at least part of the valve seat member 61D to cause a radially inwardly compressing relation on the valve seat member 61D as well as a radially outwardly compressing relation on the O-ring member 78 to provide an effective seal between the valve member 34D and the valve seat member 61D to close the vapor recovery passage 46D for the purpose previously set forth.

Thus, it can be seen that the valve seat member 61D does not seal against the internal annular peripheral surface 65C of the valve member 34D but only against the O-ring member 78 thereof so that when the valve member 78 moves out of sealing engagement with the O-ring valve seat member 61D, the check valve means 60D is open as illustrated in FIG. 14.

Figure 15:
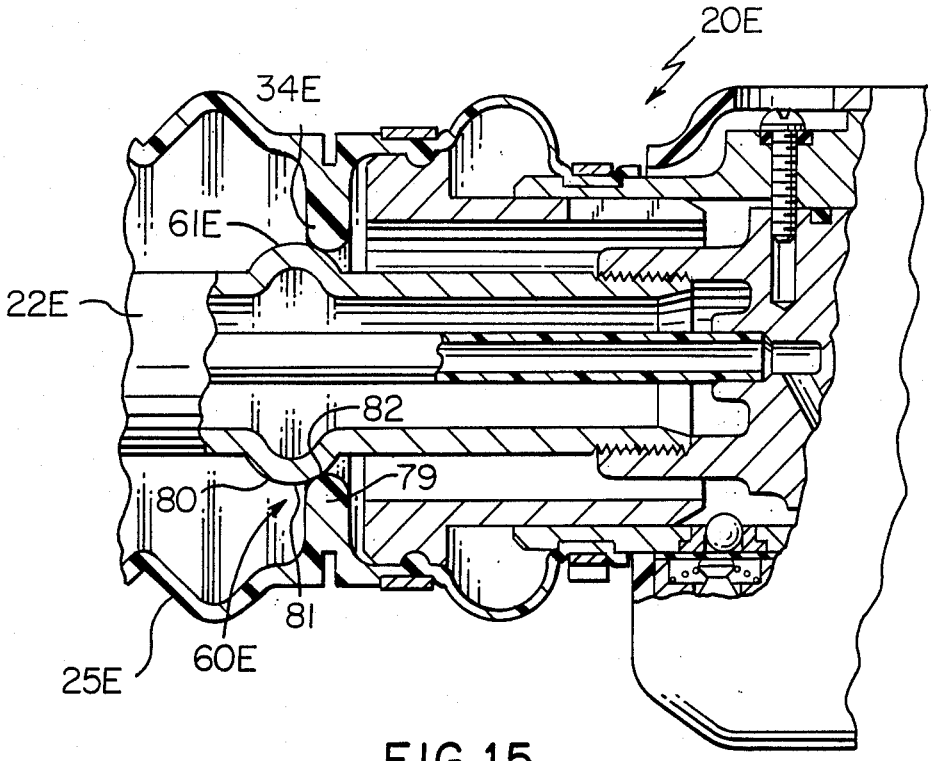
FIG. 15 is a view similar to FIG. 5 and illustrates another valve means of this invention.
Figure 16:
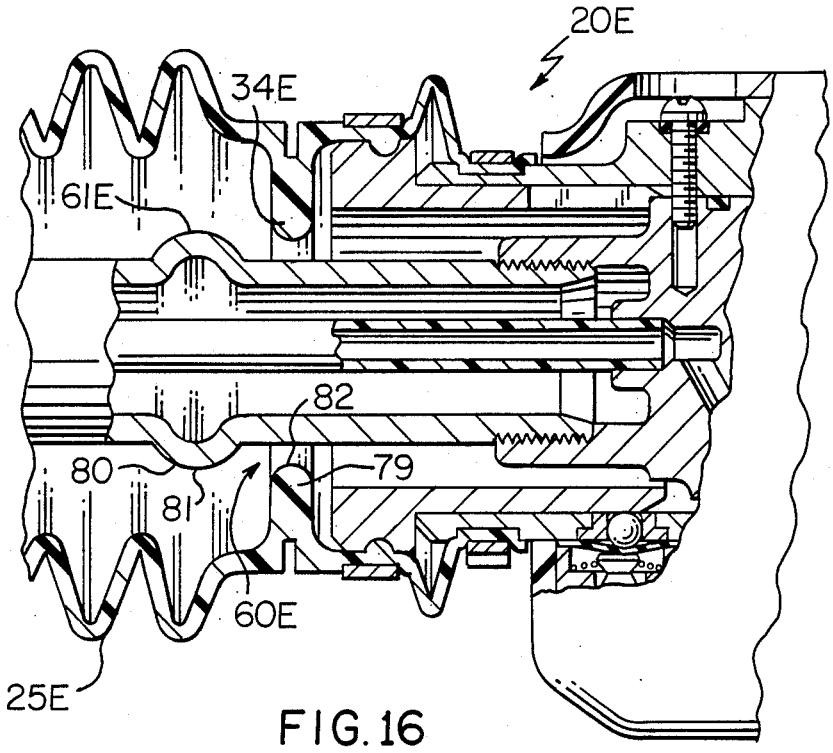
FIG. 16 is a view similar to FIG. 15 and illustrates the valve means of FIG. 15 in an open condition thereof.

Another fluid dispensing nozzle of this construction is generally indicated by the reference numeral 20E in FIG. 15 and 16 and parts thereof similar to the parts of the nozzle constructions 20, 20A, 20B, 20C and 20D previously described are indicated by like reference numerals followed by the reference letter "E".

As illustrated in FIGS. 15 and 16, the valve member 34E of the tube 25E of the nozzle construction 20E forms an integral part thereof and comprises an inwardly directed annular rib 79 that is substantially solid and formed of the same material as the tube 25E.

Also, the valve seat means 61E of the check valve means 60E of the nozzle construction 20E comprises an integral part of the tube 22E and is an annular projection 80 thereof that defines an arcuate external peripheral surface 81 against which the arcuate internal peripheral surface 82 of the valve member 34E can wipe or slide over as illustrated in FIG. 15 to close the check valve means 60E for the reasons previously set forth.

Therefore, it can be seen that the nozzle construction 20E has the valve member of the tube 25E forming an integral part thereof and has the valve seat member of the spout 22E likewise forming an integral part thereof with the resulting check valve means 60E functioning in the same manner as the check valve means previously set forth.

Therefore, it can be seen that this invention not only provides new fluid dispensing nozzle constructions but also this invention provides new methods of making fluid dispensing nozzle constructions.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a fluid dispensing nozzle construction comprising a valve body having a dispensing spout extending therefrom, and a flexible bellows-like tube of polymeric material telescopically disposed on said spout and having opposed ends one of which is secured to said valve body and the other of which carries a face seal means for engaging an annular lip of a fill pipe of a fluid storage tank to seal around an opening in said fill pipe when said spout is inserted therein, said spout and said tube defining a vapor recovery passage therebetween that leads from said seal means to said valve body, said spout having a valve seat member threon, said tube carrying a valve member that moves therewith and that cooperates with said valve seat member to close said passage intermediate said seal means and said valve body when said tube is in a certain first compressed condition thereof between said seal means and said valve body and to open said passage when said tube is in a certain greater compressed condition thereof between said seal means and said valve body, the improvement wherein said valve member has an internal annular cylindrical surface that has a substantially uniform size and circular transverse cross-sectional configuration throughout the length thereof and that slides over at least part of said valve seat member in sealing engagement therewith to close said passage when said tube is in said first compressed condition thereof, said valve seat member comprising a one-piece member formed of flexible material that has at least a part thereof that if placed in radial compression when said members are in said sealing engagement thereof, said valve seat member having a body portion provided with an opening passing therethrough and press-fittingly receiving said spout therein whereby said valve seat member is sealed to said spout by said press-fit relation therewith.

2. A fluid dispensing nozzle construction as set forth in claim 1 wherein said part of said valve seat member comprises an annular flexible lip that is placed in radial compression when said annular cylindrical surface slides over the same to provide said sealing engagement therebetween.

3. A fluid dispensing nozzle construction as set forth in claim 2 wherein said valve member comprises a tubular member having opposed open ends and having said annular cylindrical surface disposed between said ends thereof.

4. A fluid dispensing nozzle construction as set forth in claim 3 wherein one of said open ends of said tubular member is spaced from said lip when said tube is in said certain greater compressed condition thereof whereby said passage is open and is telescoped over said lip when said tube is in said first compressed condition thereof whereby said passage is closed.

5. A fluid dispensing nozzle construction as set forth in claim 4 wherein said one end of said tubular member has a beveled cam surface adjacent said internal annular cylindrical surface thereof to facilitate the insertion of said lip into said one end of said tubular member.

6. A fluid dispensing nozzle construction as set forth in claim 4 wherein said tubular member comprises an actuator for said valve body.

7. A fluid dispensing nozzle construction as set forth in claim 4 wherein said body portion of said valve seat member has an inwardly directed annular projection, said spout having an annular groove therein receiving said annular projection therein.

8. A fluid dispensing nozzle construction as set forth in claim 4 wherein said lip projects outwardly from said body portion of said valve seat member at an angle relative thereto and in a direction that faces away from said one end of said tubular member when said tube is in said certain greater compressed condition thereof.

* * * * *